US007467841B2

(12) United States Patent
Kamisuwa et al.

(10) Patent No.: US 7,467,841 B2
(45) Date of Patent: Dec. 23, 2008

(54) MAINTENANCE SCHEDULING SYSTEM, MAINTENANCE SCHEDULING METHOD AND IMAGE FORMING APPARATUS

(75) Inventors: Yoshikatsu Kamisuwa, Tokyo (JP); Rintaro Nakane, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 161 days.

(21) Appl. No.: 11/470,963

(22) Filed: Sep. 7, 2006

(65) Prior Publication Data

US 2008/0062211 A1 Mar. 13, 2008

(51) Int. Cl.
*B41J 29/393* (2006.01)

(52) U.S. Cl. ..... 347/19; 347/85; 347/22

(58) Field of Classification Search ..... 347/19
See application file for complete search history.

(56) References Cited

U.S. PATENT DOCUMENTS

2005/0002054 A1* 1/2005 Shoji et al. ..... 358/1.14
2005/0286742 A1* 12/2005 Rasmussen et al. ..... 382/112

FOREIGN PATENT DOCUMENTS

JP 2004-152017 5/2004

OTHER PUBLICATIONS

Kamisuwa, Yoshikatsu, Pending U.S. Appl. No. 11/427,770, filed Jun. 29, 2006.

Kamisuwa, Yoshikatsu, Pending U.S. Appl. No. 11/277,208, filed Mar. 22, 2006.

* cited by examiner

*Primary Examiner*—Matthew Luu
*Assistant Examiner*—Brian J Goldberg
(74) *Attorney, Agent, or Firm*—SoCal IP Law Group LLP; Steven C. Sereboff; John E. Gunther

(57) ABSTRACT

A maintenance scheduling system for creating a maintenance schedule for an image forming apparatus includes an actual use acquiring unit configured to acquire actual use information of the image forming apparatus and actual use information of a consumable part, a failure probability distribution estimating unit configured to estimate failure probability distribution of the consumable part on the basis of history of actual use information of the consumable part, a counter proceeding degree acquiring unit configured to acquire a counter proceeding degree, which is a counter value per day, on the basis of history of actual use information of the image forming apparatus, and a maintenance scheduling unit configured to present next replacement timing and a consumable part to be replaced, on the basis of the failure probability distribution of each of the consumable parts and the counter proceeding degree.

22 Claims, 14 Drawing Sheets

| | Previous replacement count | End of life |
|---|---|---|
| Photoconductive drum | 500,567 | ○ |
| Feed roller | 340,101 | × |
| Developer | 834,478 | ○ |
| Fixing roller 1 | 380,074 | × |
| | ⋮ | |
| Transfer belt | 500,567 | ○ |

FIG. 5

| ID | Machine. ID | Machine type. Name | Consumable part. Abbreviation | Visit date | Counter | Failure interval | End of life |
|---|---|---|---|---|---|---|---|
| 020901005 | 100213 | Machine type. A | Setup | 2002/9/1 | 0 | 0 | – |
| | | | ∫ | | | | |
| 030128001 | 100213 | Machine type. A | No problem | 2003/1/28 | 515907 | – | – |
| 030407010 | 100213 | Machine type. A | Photoconductive drum | 2003/4/7 | 746343 | 241052 | X |
| 030421001 | 100213 | Machine type. A | Photoconductive drum | 2003/4/21 | 786417 | 40074 | X |
| | | | ∫ | | | | |
| 021115001 | 102399 | Machine type. A | Photoconductive drum | 2002/11/15 | 52354 | 33466 | X |
| 021120002 | 102399 | Machine type. A | Photoconductive drum | 2002/11/20 | 53366 | 1012 | X |
| 021122001 | 102399 | Machine type. A | Photoconductive drum | 2002/11/22 | 54450 | 1084 | X |
| 030523008 | 102399 | Machine type. A | PM all-replacement | 2003/5/23 | 570954 | 516504 | ○ |
| 030529011 | 102399 | Machine type. A | No reproduction | 2003/5/27 | 572918 | – | – |
| 030529004 | 102399 | Machine type. A | Charger wire | 2003/5/29 | 578500 | 7546 | – |
| | | | ∫ | | | | |
| 031217001 | 102400 | Machine type. A | PM all-replacement | 2003/12/17 | 1211848 | 136328 | ○ |
| 031218003 | 102400 | Machine type. A | Fixing roller 1 | 2003/12/18 | 1211898 | 50 | – |
| | | | ∫ | | | | |
| 030507006 | 112240 | Machine type. A | Photoconductive drum | 2003/5/7 | 1108467 | 12356 | X |
| | | | ∫ | | | | |
| 030714003 | 139855 | Machine type. B | PM all-replacement | 2003/7/14 | 1465441 | 305552 | – |
| 030723003 | 139855 | Machine type. B | Stain on original table glass | 2003/7/23 | 1465490 | 49 | – |

FIG. 6

| Machine type. Name | Abbreviation | Failure distribution classification | Failure distribution paramete 1 | Failure distribution parameter 2 | Failure distribution parameter 3 |
|---|---|---|---|---|---|
| Machine type. A | Photoconductive drum | 0 | 3.2 | 623K | – |
| Machine type. A | Feed roller | 0 | 5.1 | 500K | – |
| Machine type. A | Transfer belt | 0 | 1.2 | 821K | – |
| ∫ | | ∫ | | | |
| Machine type. B | Photoconductive drum | 0 | 1.5 | 790K | – |
| Machine type. B | Feed roller | 0 | 5.3 | 520K | – |
| ∫ | | ∫ | | | |

FIG. 7

| Machine . ID | Counter acquisition date | Total counter |
|---|---|---|
| 100213 | 2004/1/26 | 1025392 |
| 100213 | 2004/1/27 | 1025401 |
| 100213 | 2004/1/28 | 1027012 |
| ∫ | | |
| 102399 | 2004/1/12 | 1276511 |
| 102399 | 2004/1/13 | 1279732 |
| ∫ | | |
| 102400 | 2004/1/28 | 2697196 |
| ∫ | | |

FIG. 8

| ID | | Counter proceeding average | Counter proceeding distribution | Counter acquisition date | Total counter | |
|---|---|---|---|---|---|---|
| 100213 | | 2634 | 1815 | 2004/1/28 | 1027012 | |
| 102399 | | 4565 | 3212 | 2004/1/13 | 1279732 | |
| 102400 | | 6012 | 3604 | 2004/1/28 | 2697196 | |
| | | | ∫ | | | |

FIG. 9

| Machine . ID | Consumable part. Abbreviation | Counter acquisition date | Counter | |
|---|---|---|---|---|
| 102399 | Photoconductive drum | 2003/5/23 | 0 | |
| 102399 | Charger wire | 2003/5/29 | 0 | |
| 102399 | Transfer belt | 2003/5/23 | 0 | |
| | | ∫ | | |
| 112400 | Photoconductive drum | 2003/5/7 | 0 | |
| 112400 | Charger wire | 2003/3/25 | 0 | |
| | | ∫ | | |

FIG. 10

Sample 1

| Machine . ID | Abbreviation | Visit interval | Replacement interval |
|---|---|---|---|
| 100213 | Photoconductive drum | 600K | 540K |
| 100213 | Feed roller | 480K | 430K |
| | ⋮ | | |
| 100213 | Transfer belt | 750K | 670K |

Sample 2

| Machine . ID | Abbreviation | Visit interval | Replacement interval |
|---|---|---|---|
| 100213 | Photoconductive drum | 550K | 530K |
| 100213 | Feed roller | 500K | 450K |
| | ⋮ | | |
| 100213 | Transfer belt | 800K | 740K |

Sample 3

| Machine . ID | Abbreviation | Visit interval | Replacement interval |
|---|---|---|---|
| 100213 | Photoconductive drum | 450K | 450K |
| 100213 | Feed roller | 460K | 400K |
| | ⋮ | | |
| 100213 | Transfer belt | 770K | 740K |

⋮

Sample 2000

| Machine . ID | Abbreviation | Visit interval | Replacement interval |
|---|---|---|---|
| 100213 | Photoconductive drum | 580K | 550K |
| 100213 | Feed roller | 460K | 440K |
| | ⋮ | | |
| 100213 | Transfer belt | 850K | 830K |

FIG. 11

| Strategy number | Cost |
|---|---|
| 1 | 0.658 |
| 2 | 0.667 |
| 3 | 0.701 |
| 4 | 0.558 |
| 5 | 0.667 |
| ⋮ | |
| 112 | 0.489 |
| ⋮ | |
| 2000 | 0.600 |

FIG. 13

| | Visit interval | Replacement interval |
|---|---|---|
| Photoconductive drum | 610K | 550K |
| Feed roller | 400K | 350K |
| Developer | 880K | 820K |
| Fixing roller 1 | 410K | 350K |
| ⋮ | | |
| Transfer belt | 750K | 720K |

FIG. 14

Tuesday, January 24, 2006

Machine serial number : 100213

----Optimum maintenance schedule calculation result----

Next visit date : Thursday, February 23, 2006

Consumable part to be replaced : Photoconductive drum, Fixing roller 1, Fixing roller 2

FIG. 16

MAINTENANCE SCHEDULING SYSTEM, MAINTENANCE SCHEDULING METHOD AND IMAGE FORMING APPARATUS

BACKGROUND OF THE INVENTION

1. Field of the Invention

This invention relates to a technique of estimating the timing of failure of a product including plural components and the degree of degradation of each component, and reflecting them onto a maintenance schedule.

2. Description of the Related Art

Conventional maintenance scheduling is based on the experience and intuition of individual servicemen. Therefore, the risk of damage to a user caused by the unavailability of a product and the maintenance cost cannot be balanced with each other.

That is, if a component that is very likely to have failure is replaced before the end of its life in order to reduce the risk of product failure, the replacement operation takes place more than necessary and increases the maintenance cost. Conversely, if a component is used up to its full life in order to lower the maintenance cost, the component is replaced after failure occurs. Therefore, the downtime is long and the damage to the user caused by the unavailability of the product increases. Such trade-off relations exist.

A technique of setting a maintenance schedule based on the cost and risk is disclosed. In this technique, whether to carry out maintenance or not is determined on the basis of the risk, but which component is to be replaced is not determined (see JP-A-2004-152017).

BRIEF SUMMARY OF THE INVENTION

A maintenance scheduling system according to a first aspect of the invention is a maintenance scheduling system for creating a maintenance schedule for an image forming apparatus that forms an image and sends and receives information to and from an external device. The system includes: an actual use acquiring unit configured to acquire actual use information of the image forming apparatus (including a counter value corresponding to the number of times an image is formed and the date and time when the counter value is acquired) and actual use information of a consumable part (including the counter value at the time of replacing the consumable part and life information indicating whether the reason for replacement of the consumable part is the end of its life or not); a failure probability distribution estimating unit configured to estimate failure probability distribution of the consumable part on the basis of history of actual use information of the consumable part; a counter proceeding degree acquiring unit configured to acquire a counter proceeding degree, which is a counter value per day, on the basis of history of actual use information of the image forming apparatus; and a maintenance scheduling unit configured to present next replacement timing and the consumable parts to be replaced, on the basis of the failure probability distribution of each of the consumable parts and the counter proceeding degree.

A maintenance scheduling method according to a second aspect of the invention is a maintenance scheduling method for creating a maintenance schedule for an image forming apparatus that forms an image and sends and receives information to and from an external device. The method includes the steps of: acquiring actual use information of the image forming apparatus (including a counter value corresponding to the number of times an image is formed and the date and time when the counter value is acquired) and actual use information of a consumable part (including the counter value at the time of replacing the consumable part and life information indicating whether the reason for replacement of the consumable part is the end of its life or not); estimating failure probability distribution of the consumable part on the basis of history of actual use information of the consumable part; acquiring a counter proceeding degree, which is a counter value per day, on the basis of history of actual use information of the image forming apparatus; and presenting next replacement timing and the consumable parts to be replaced, on the basis of the failure probability distribution of each of the consumable parts and the counter proceeding degree.

An image forming apparatus according to a third aspect of the invention is an image forming apparatus that forms an image and sends and receives information to and from an external device. The apparatus includes: a storage unit configured to store actual use information of the image forming apparatus (including a counter value corresponding to the number of times an image is formed and the date and time when the counter value is acquired) and actual use information of a consumable part (including the counter value at the time of replacing the consumable part and life information indicating whether the reason for replacement of the consumable part is the end of its life or not); and an information transmitting unit configured to transmit the actual use information of the image forming apparatus and the actual use information of the consumable part to a maintenance scheduling system for creating a maintenance schedule for the image forming apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 5 shows information held in a memory of MFP.

FIG. 6 shows an exemplary "maintenance history" table.

FIG. 7 shows an exemplary "consumable part" table.

FIG. 8 shows an exemplary "counter history" table.

FIG. 9 shows an exemplary "machine" table.

FIG. 10 shows an exemplary "state of consumable part" table.

FIG. 11 shows samples used for a simulation.

FIG. 13 shows the result of simulation for each sample.

FIG. 14 shows an example of information held in the memory of MFP.

FIG. 16 shows the result of output in a "visit time presentation mode".

DETAILED DESCRIPTION OF THE INVENTION

Hereinafter, an embodiment of this invention will be described using an image processing device (multifunction peripheral or MFP) 201 as an example.

The MFP 201 is a digital multifunction peripheral for not only scanning, reading and copying an image with designated resolution and paper size, but also integrally utilizing various office equipment functions such as FAX image receiving function, E-mail image receiving function, and print image receiving function based on a network.

Figure 1:
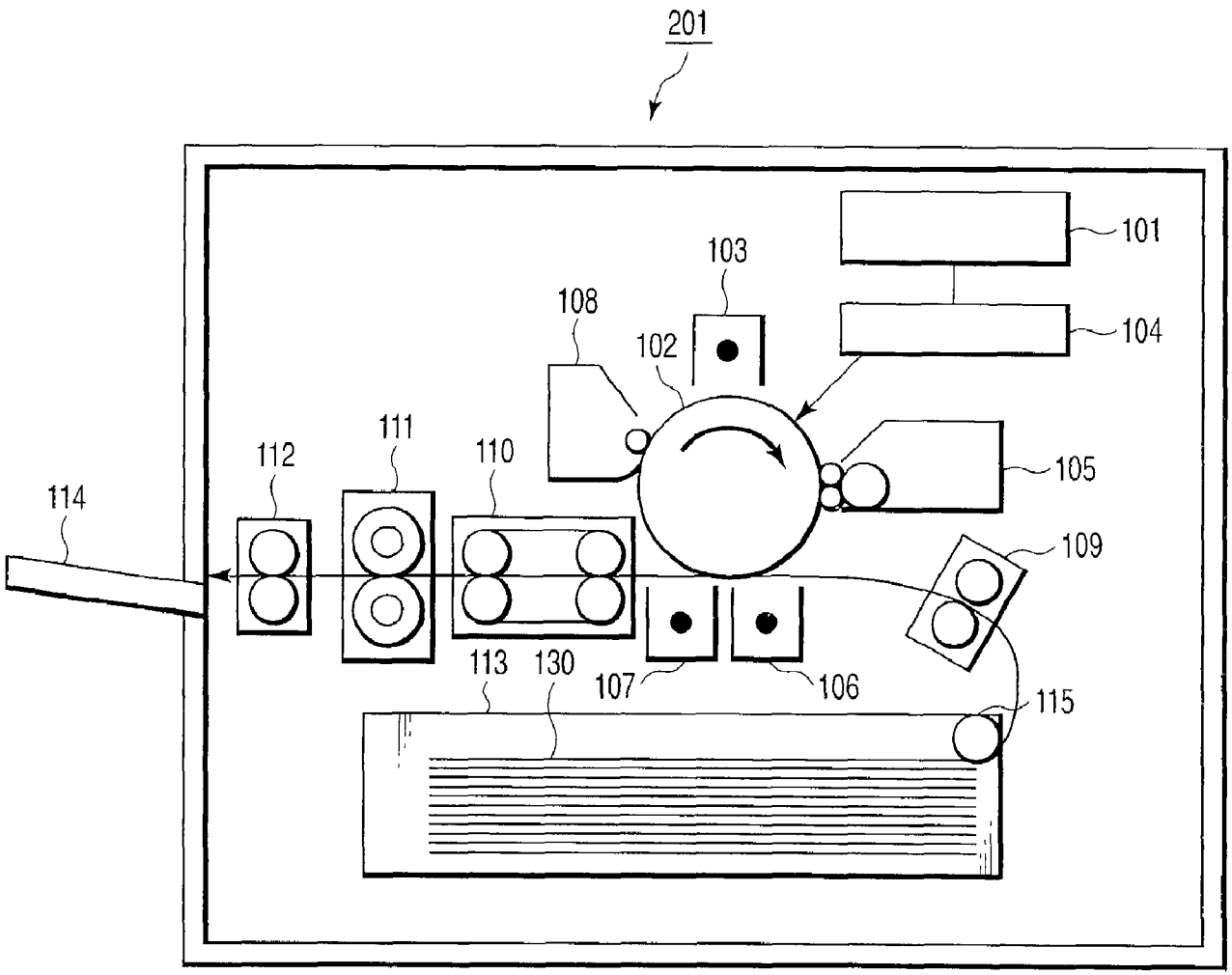
FIG. 1 is a block diagram showing a configuration of a copy function of MFP.

FIG. 1 is a block diagram showing the configuration of the copy function of the MFP 201.

The MFP 201 has a control unit 101, a photoconductive drum 102, a charger 103, a scanning and exposure unit 104, a developing unit 105, a transfer charger 106, a separation charger 107, a cleaner 108, a paper feeder unit 109, a paper carrier unit 110, a fixing unit 111, a paper discharge unit 112, and a paper discharge tray 114.

The photoconductive drum 102 rotates in a sub-scanning direction (the circumferential direction of the photoconductive drum 102). The charger 103 is arranged near the photoconductive drum 102. The charger 103 evenly charges the surface of the photoconductive drum 102. The scanning and exposure unit 104 emits light or turns off in accordance with an image signal while scanning with a semiconductor laser in the scanning and exposure unit 104. A laser beam radiated from this semiconductor laser is turned into light that scans in a main scanning direction (the direction of the rotation axis of the photoconductive drum 102) by a deflector such as a polygon mirror. The laser beam is cast onto the photoconductive drum 102 by an optical system such as a lens or the like. When the charged photoconductive drum 102 is irradiated with the laser beam, the potential at the irradiated site is lowered and an electrostatic latent image is formed.

The developing unit 105 applies a developer to the photoconductive drum 102, thereby forming a toner image on the photoconductive drum 102. In a bottom part of the image forming apparatus 100, a paper tray 113 is provided. A paper feed roller 115 separates papers 130 in the paper tray 113 one by one and sends out each paper to the paper feeder unit 109. The paper feeder unit 109 supplies the paper 130 to the transfer position of the photoconductive drum 102. The transfer charger 106 transfers the toner image to the supplied paper 130. The separation charger 107 separates the paper 130 from the photoconductive drum 102.

The paper 130 on which the toner image has been transferred is carried by the paper carrier unit 110. The fixing unit 111 fixes the toner image to the paper 130. The paper discharge unit 112 discharges the paper 130 having the image printed thereon to the paper discharge tray 140.

After the transfer of the toner image to the paper 130 ends, the remaining toner on the photoconductive drum 102 is removed by the cleaner 108. The photoconductive drum 102 restores its initial state and enters a standby state for next image formation.

As the above process operation is repeated, an image forming operation is continuously carried out.

Figure 2:
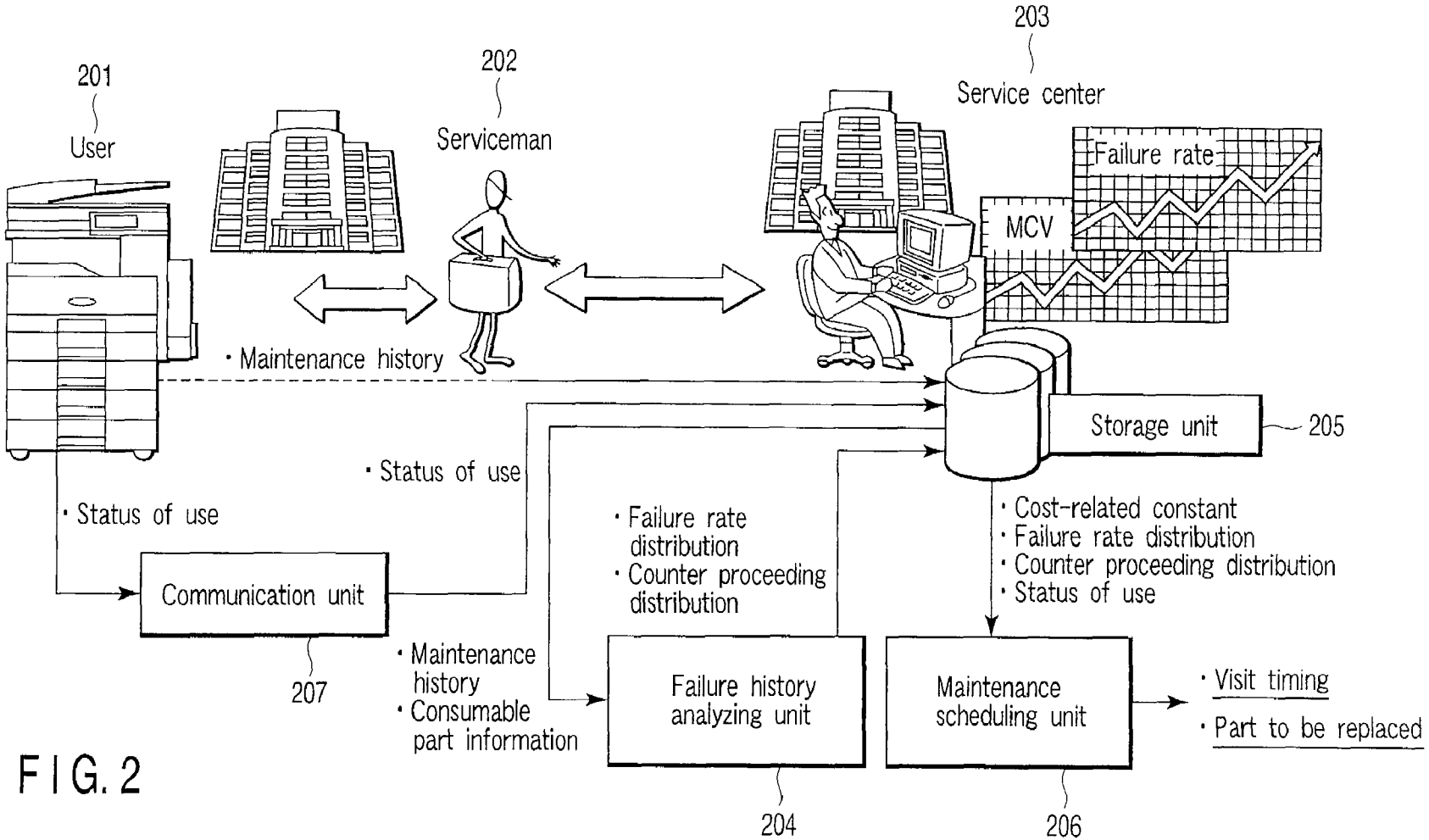
FIG. 2 is a view of system configuration showing an outline of a maintenance scheduling system according to an embodiment of the invention.

FIG. 2 is a view of system configuration showing the outline of a maintenance scheduling system according to an embodiment of this invention. FIG. 2 shows an example in which a maintenance schedule for the MFP 201 installed at a user's location is made by the maintenance scheduling system according to this embodiment and in which a serviceman 202 carries out maintenance services according to the maintenance schedule.

The conventional maintenance techniques include preventive maintenance (PM) and emergency maintenance (EM). In PM, the serviceman 202 visits a MFP 201 that is a maintenance target at periodic timing set for each MFP, and carries out replacement of consumable parts, cleaning, and operation check of the MFP 201. In EM, when failure accidentally occurs, the serviceman receives a service call from the user and makes a visit to repair the MFP 201.

As for the PM operation, there are plural consumable parts in one MFP 201 and all the consumable parts are not degraded at the time of PM. If the consumable parts that have not reached the end of their lives are replaced, it causes loss. Also, when accidental failure occurs, if only the consumable part that has failure is replaced at that time, the replacement timing deviates from the PM cycle.

In such circumstances, it is difficult to determine which parts should be replaced and which parts should be left for continuous use when the serviceman visits the client for PM or EM.

That is, while basically following a preset PM cycle, the serviceman 202 adjusts the replacement timing for each consumable part individually on the basis of experience and thus tries to reduce the loss. However, if reduction in the cost is attempted by indiscriminately delaying the replacement timing and extending the time of using the consumable parts, a risk of failure for the consumable parts is increased and the unavailability of the MFP causes damage to the user. Moreover, if the replacement timing is changed individually for each consumable part, it may be considered that the number of visits increases, which conversely increases the maintenance cost.

Thus, the maintenance scheduling system 1 according to this embodiment creates a more detailed maintenance schedule for consumable parts, instead of replacing them only in the PM cycle. Two indexes are set, that is, "visit interval" indicating "when to visit the client", and "replacement interval" indicating which consumable part should be replaced" at the time of visiting the client. Then, the serviceman visits the client for PM in accordance with the "visit interval", and when visiting the client for PM or EM, the serviceman decides to replace or not to replace components other than PM or EM target components in accordance with the "replacement interval". This optimizes the maintenance cost and the risk of failure.

The maintenance method shown in FIG. 2 will be described in detail. From one service center 203 as the base, plural servicemen 202 carry out maintenance of plural MFPs 201 installed in plural users' places.

At the end of the operation, each serviceman 202 sends maintenance history data to the maintenance scheduling system 1 via a communication unit 207 of the MFP 201. As for the MFP 201 having only the conventional communication function, the serviceman 202 goes back to the service center 203 and then inputs maintenance history data to the maintenance scheduling system 1 on the basis of an operation record gathered as a maintenance service report. These maintenance history data are stored into a storage unit 205.

When a preset regular communication time has come (for example, ten o'clock every day), the MFP 201 communicates data related to the status of use to the maintenance scheduling system 1. These data related to the status of use are stored into the storage unit 205.

In the maintenance scheduling system 1, a failure history analyzing unit 204 calculates failure rate distribution for each consumable part on the basis of the past maintenance history data, and predicts failure based on the failure rate distribution. A maintenance scheduling unit 206 calculates next visit timing and a list of consumable parts to be replaced at that timing, in accordance with the data related to the status of use of the MFP 201 gathered via the communication unit 207.

Figure 3:
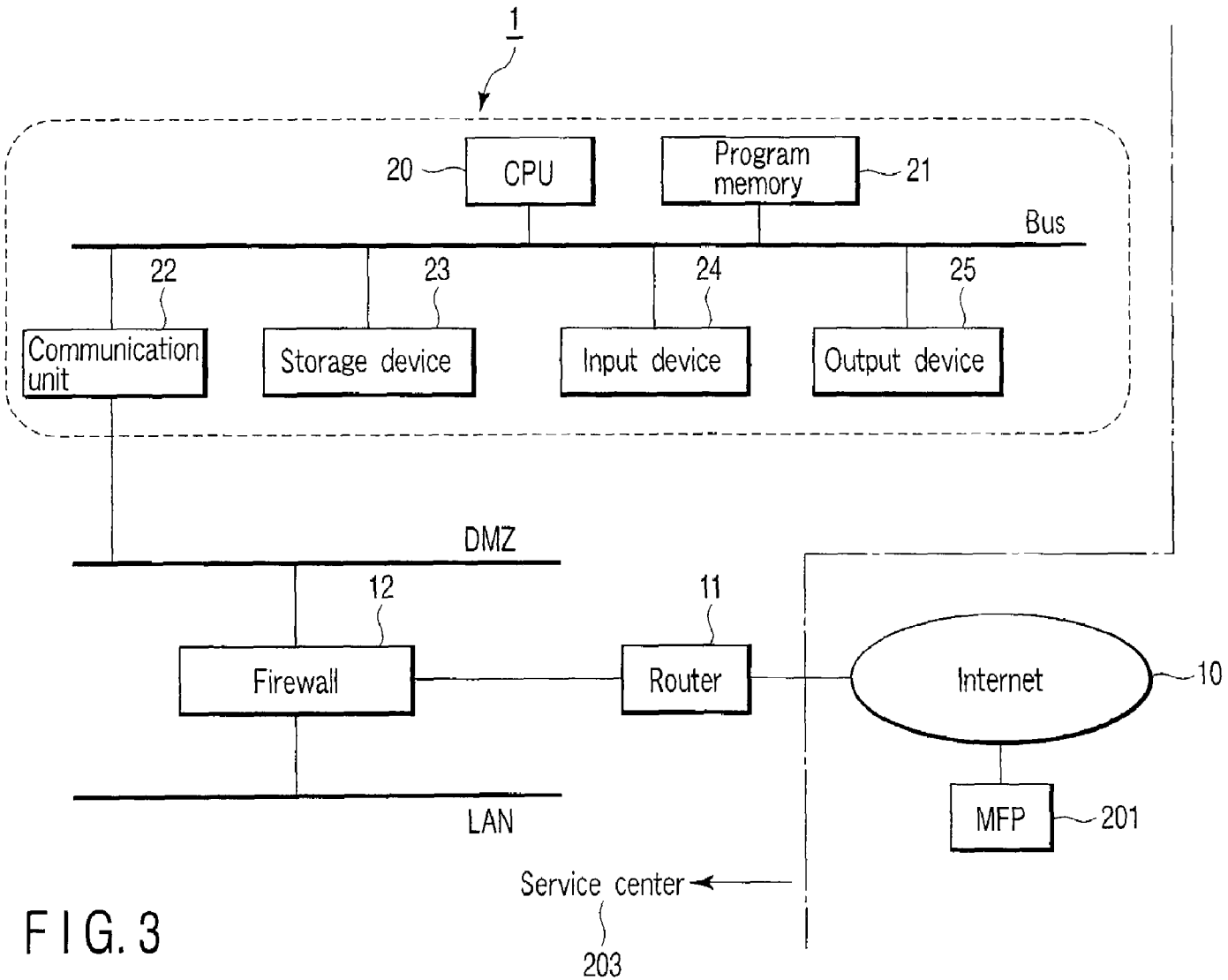
FIG. 3 shows a configuration of a service center-side system including the maintenance scheduling system.

FIG. 3 shows a configuration of a service center-side system including the maintenance scheduling system 1.

The service center 203 is provided with a router 11 and the firewall 12, thus eliminating unauthorized accesses to the maintenance scheduling system. The maintenance scheduling system 1 is connected to a demilitarized zone behind the firewall 12.

The maintenance scheduling system 1 is provided with a CPU 20, a program memory 21, a communication unit 22, a storage device 23, an input device 24 and an output device 25.

The CPU 20 controls the entire operations of the maintenance scheduling system 1. A program to be operated in the maintenance scheduling system 1 is stored in the program memory 21. For example, the failure history analyzing unit 204 and the maintenance scheduling unit 206 are stored. The communication unit 22 is an interface for sending and receiving information to and from the MFP 201 via the Internet 10. The storage device 23 is provided with the storage unit 205 in which the data related to the maintenance history and the data related to the status of use are stored. The input device 24 is an input unit such as keyboard or mouse for inputting an instruction or data to the maintenance scheduling system 1. The output device 25 is a display device for presenting information.

Next, the function of each unit constituting the maintenance scheduling system 1 will be described with reference to FIG. 2. The maintenance scheduling unit 206 is further provided with the functions of a visit interval calculating unit, a replacement interval calculating unit, a combination calculating unit, an interval information acquiring unit, a maintenance schedule calculating unit and the like.

The failure history analyzing unit 204 calculates failure rate distribution for each consumable part on the basis of maintenance history data as history information related to the maintenance operation that has been carried out to the MFP 201. As described above, the history information related to the maintenance operation that has been carried out to the MFP 201 is inputted by the communication from the MFP 201 or by the serviceman 202 who has carried out the maintenance operation, and thereby being stored in the storage unit 205

The maintenance scheduling unit (visit interval calculating unit) 206 randomly calculates, for each consumable part, a "visit interval" prescribing a time interval at which a visit should be made for maintenance operation, on the basis of the failure rate distribution of each consumable part. The maintenance scheduling unit (replacement interval calculating unit) 206 also randomly calculates, for each consumable part, a "replacement interval" prescribing a time interval at which the consumable part should be replaced, on the basis of the failure rate distribution of each consumable part.

The "consumable parts" here may include, for example, the photoconductor drum 102, charger wire, fixing roller, transfer belt and the like. In this embodiment, however, the "consumable parts" include a cartridge in which plural consumable parts having different functions from each other are integrally formed as a unit.

Now, the maintenance scheduling unit (visit interval calculating unit and replacement interval calculating unit) 206 calculates a value close to an interval with which it is predicted that the failure probability is equal to or higher than a predetermined probability, on the basis of the failure probability distribution of each consumable part. The visit interval calculated by the maintenance scheduling unit (visit interval calculating unit) 206 for each consumable part is set to be longer than the replacement interval calculated by the maintenance scheduling unit (replacement interval calculating unit) 206.

The maintenance scheduling unit (combination calculating unit) 206 performs search processing using the Monte Carlo method or genetic algorithm on the basis of the visit interval and the replacement interval calculated by the maintenance scheduling unit (visit interval calculating unit and replacement interval calculating unit) 206. By this search processing, it calculates a combination of a visit interval and a replacement interval that minimizes a predetermined cost, of combinations of time intervals at which a visit should be made for maintenance operation and consumable parts that should be replaced during the visit.

The "predetermined cost" described here is the sum of the labor costs required for the maintenance operation by the serviceman, the material costs of the consumable parts, and the amount of loss caused by the unavailability of the apparatus that is the maintenance target to the user.

The maintenance scheduling unit (interval information acquiring unit) 206 acquires information related to the combination of the "visit interval" and the "replacement interval" associated with the visit interval, which is the information calculated by the maintenance scheduling unit (combination calculating unit) 206.

Meanwhile, the communication unit 207 of the MEP 201 acquires the present total counter value, the present counter value of each consumable part and the like, and sends them to the maintenance scheduling system 1. The counter value in this case refers to an actual use value that is effective for grasping the degree of degradation of each consumable part mounted in the MFP 201, such as the number of sheets processed by the MFP 201, for example, the number of scanned pages of an original, the number of printed sheets or the like. Each counter value that is sent is stored into the storage unit 205.

The maintenance scheduling unit (maintenance schedule calculating unit) 206 calculates timing at which the next visit should be made and a list of consumable parts that should be replaced at that timing, on the basis of the information related to the combination acquired by the maintenance scheduling unit (interval information acquiring unit) 206 and the counter value of the MFP 201 acquired via the communication unit 207.

Figure 4:
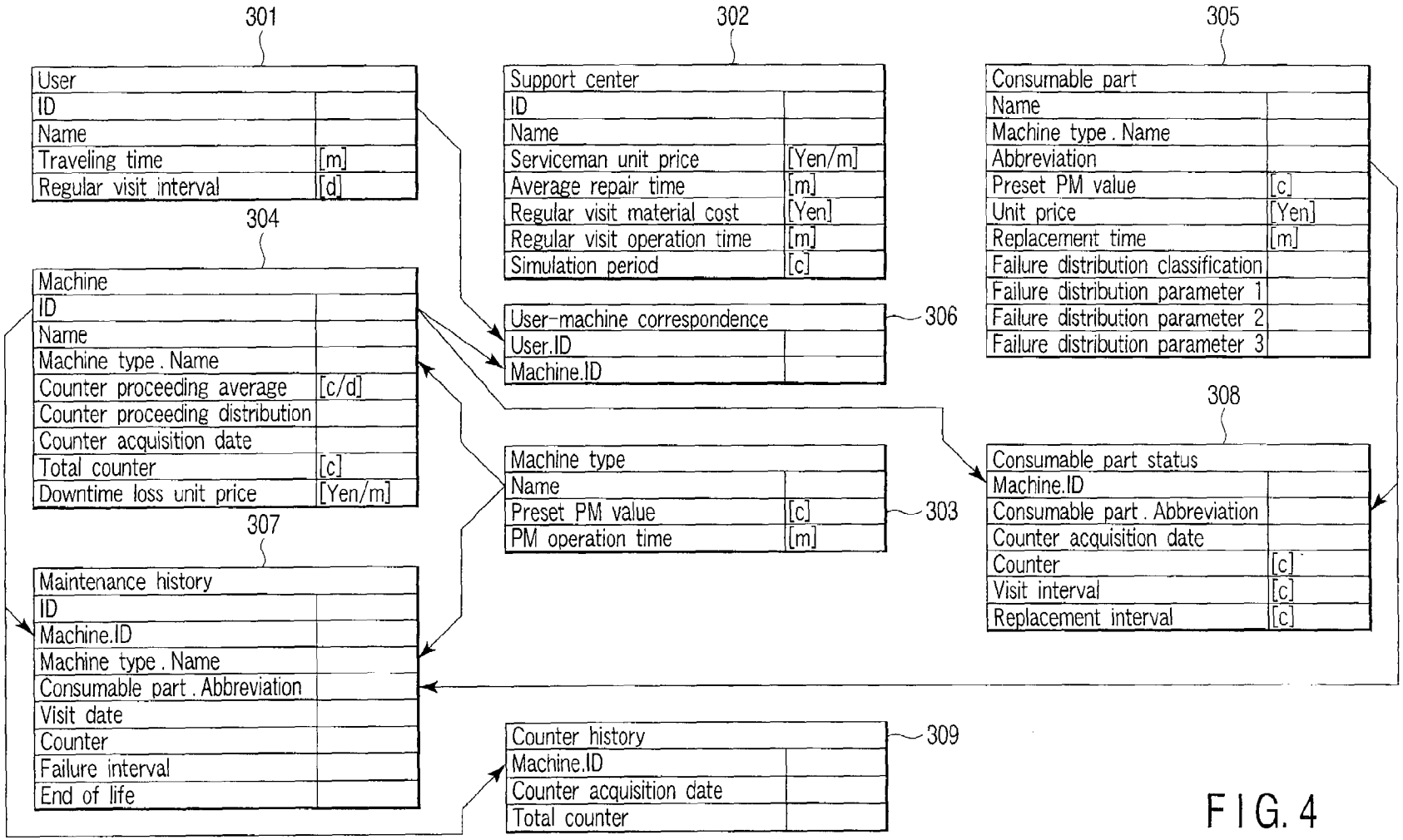
FIG. 4 shows the relation between a format of data used in the maintenance scheduling system and each data table.

FIG. 4 is a view showing the relation between a data format and each data table used in the maintenance scheduling system 1 according to this embodiment.

As the data tables used in this system, a "user" table 301, a "support center" table 302, a "machine type" table 303, a "machine" table 304, a "consumable part" table 305, a "user-machine correspondence" table 306, a "maintenance history" table 307, a "consumable part status" table 308 and a "counter history" table 309 are provided.

In the "user" table 301, a constant for each user is set. In the "support center" table 302, a constant for the support center 203 is set. In the "machine type" table 303, a constant for a machine type is set. In the "machine" table 304, a constant for each machine and a variable calculated from the status of use are set. In the "consumable part" table 305, a constant for a consumable part and a failure rate variable calculated from market data are set. In the "user-machine correspondence" table 306, the correspondence of a user and the machine owned by the user is shown. In the "maintenance history" table 307, maintenance operation history by the serviceman is recorded. In the "consumable part status" table 308, the status of each consumable part is set. In the "counter history" table 309, counter history of each machine is recorded.

The arrows in FIG. 4 indicate that the attribute of the start of the arrow is set into the attribute of the end of the arrow. The table name of the reference source is arranged before "." of the attribute of the end of the arrow, and the attribute name of the reference source is shown after ".". For example, "machine.ID" in the "maintenance history" table 307 indicates "ID" of the "machine" table 304.

The serviceman 202 updates the data set in the memory of the MFP 201 when carrying out the maintenance operation.

FIG. 5 is a view showing information held in the memory of the MFP 201. With respect to a consumable part that has become a replacement target, the serviceman 202 sets the present use counter value set in the memory of the MFP 201 to "previous replacement count" and resets the use counter value to 0. If the reason for the replacement is that the consumable part is broken, "x" is set in an "end of life" section set in the memory of the MFP 201. If the consumable part is not broken but has reached its preset life, "○" is set in the "end of life" section.

The MFP 201 has the communication unit 207 and is connected with the maintenance scheduling system 1 via the Internet or a public telephone line. At the end of the operation, the serviceman 202 executes data transmission processing to the maintenance scheduling system 1. The service center side having received the data updates the "maintenance history" table 307 stored in the storage unit 205.

To the conventional MFP 201 that does not have the communication function, the serviceman 202 inputs the data after returning to the service center 203. On the basis of the operation record gathered as a maintenance service report, the serviceman 202 updates the "maintenance history" table 307 in the storage unit 205 by following the format of the "maintenance history" table 307 and using the input device 24 provided at the service center 203.

When a regular communication time (for example, ten o'clock every day) has come, the MFP 201 carries out communication with the maintenance scheduling system 1. In this communication, the MFP 201 sends the ID number of the MFP 201, the present date and time, and the present total counter value, the present counter value of each consumable part and the like to the maintenance scheduling system 1. The maintenance scheduling system 1 reflects the information received from the MFP 201 to the "counter history" table 309 stored in the storage unit 205. After that, the MFP 201 confirms the status of communication and additional information, and ends the communication with the maintenance scheduling system 1.

FIG. 6 is a view showing an exemplary "maintenance history" table 307 with its contents updated as described above.

The "counter" section in the "maintenance history" table 307 shows a counter value indicating how many sheets are outputted as of A4 size, where 1 represents copying or printing in A4 and 2 represents copying or printing in A3. The "total counter value" in the "counter history" table 309 takes a similar value.

The failure history analyzing unit 204 estimates failure rate distribution of each consumable part based on the "maintenance history" table 307. In the failure distribution analysis, it performs fitting to Weibull distribution (where m represents shape parameter and q represents scale parameter) expressed by the following equation (1).

$$F(t)=1-e\{-(t/\eta)\hat{}m\} \quad (1)$$

Hereinafter, a method for analyzing failure distribution of the photoconductive drum 102, which is a consumable part of machine type A, will be described with reference to FIG. 6.

The failure history analyzing unit 204 refers to the "failure interval" and "end of life" columns in the "maintenance history" table 307 read from the storage unit 205 in order to find failure rate distribution of the photoconductive drum 102.

For the maintenance history of the conventional machine having no communication unit, the "failure interval" is not set. In this case, the data related to the photoconductive drum 102 is extracted and the failure interval is calculated. That is, all the tuples having "machine type.name" of "machine type A" and "consumable part.abbreviation" of "photoconductive drum", and all the tuples having "machine type.name" of "machine type A" and "consumable part.abbreviation" of "PM all-replacement" are extracted from the "maintenance history" table 307, and the failure interval is calculated from the difference from the counter value in the previous replacement.

An entry having "x" in the "end of life" column at the right end in the "maintenance history" table 307 is data acquired when failure occurs before the photoconductive drum 102 reaches PM, and an entry having "○" is data acquired when replacement is done because PM is reached without failure. The data thus acquired when replacement is made before failure (entry having "○") is referred to as "abort data". As an analysis method for such data, a cumulative hazard method is known. The shape parameter m and the scale parameter η of Weibull distribution are estimated on the basis of the failure interval of each tuple calculated by using the cumulative hazard method. Then, a failure distribution-related variable in the "consumable part" table 305 is updated. FIG. 7 is a view showing an example of the "consumable part" table 305.

The failure history analyzing unit 204 extracts tuples in which "machine type.name" and "abbreviation" in the "consumable part" table 305 coincide with "machine type A" and "photoconductive drum", and substitutes the shape parameter m into the "failure distribution parameter 1" and the scale parameter η into the "failure distribution parameter 2". In the "failure distribution classification" section, a constant (=0) corresponding to Weibull distribution is set. This calculation is used for each consumable part and the "consumable part" table 305 in the storage unit 205 is updated.

FIG. 8 is a view showing an example of the "counter history" table 309. FIG. 9 is a view showing an example of the "machine" table 304.

The failure history analyzing unit 204 calculates proceeding distribution of the number of copied sheets per day for each machine, on the basis of the "counter history" table 309. That is, tuples having the same "machine.ID" are extracted from the "counter history" table 309. Then, an average value and distribution of counter change quantities (proceeding degrees) per day are calculated on the basis of the difference in the "counter acquisition date" (number of days) and the quantity of change in the "total counter". Then, the calculated average value of the counter proceeding degrees is substituted into the "counter proceeding average" section in the "machine" table 304, and the calculated distribution of the counter proceeding degrees is substituted into the "counter proceeding distribution" section.

Next, the failure history analyzing unit 204 extracts tuples having the same "machine.ID" from the "counter history" table 309. Then, it specifies a tuple having the latest "counter acquisition date" from all the extracted tuples. The "counter acquisition date" of the specified tuple is substituted into "counter acquisition date" in the "machine" table 304, and the "total counter" value of the specified tuple is substituted into "total counter" of the "machine" table 304.

FIG. 10 is a view showing exemplary data of the "consumable part status" table 308.

The failure history analyzing unit 204 extracts tuples having the same "machine.ID" from the "counter history" table 307. It also extracts tuples having "consumable part.abbreviation" of the consumable part in question or tuples having "PM all-replacement" or "setup" from the extracted tuples. Then, a tuple having the latest "visit date" is specified. The "visit date" of the specified tuple is substituted into "counter acquisition date" in the "consumable part status" table 308, and 0 is set in the "counter" section.

Next, the operation of the maintenance scheduling unit 206 will be described.

The maintenance scheduling unit 206 has a "strategy planning mode" and a "visit date presentation mode". The "strategy planning mode" is a mode for executing creation of an optimum maintenance schedule when a given quantity of maintenance history data is additionally registered to the storage unit 205 or at periodic timing such as once a month. The "visit date presentation mode" is a mode for the serviceman 202 to check he contents of the created maintenance schedule. The serviceman 202 uses this mode almost every day.

First, the "strategy planning mode" will be described.

The maintenance scheduling unit 206 calculates and sets a "visit interval" and a "replacement interval" for each consumable part of each machine. The serviceman 202 carries out maintenance operations based on these "visit interval" and "replacement interval".

That is, if at least one of a consumable part of an MFP 201 that is a maintenance target has reached the "visit interval", the serviceman 202 makes a visit to the apparatus. Then, the serviceman 202 replaces all the consumable parts that have reached the "replacement interval" at the time of this visit.

Next, the method for calculating a "visit interval" and a "replacement interval" will be described in detail.

The maintenance scheduling unit 206 sets plural combinations of "visit intervals" and "replacement intervals" included in a period that is set as a "simulation period" in the "support center" table 302. Using these combination data, it conducts a maintenance operation simulation and calculates a "visit interval" and a "replacement interval" that minimize the required cost. As the calculation method, a heuristic method, for example, the Monte Carlo method or genetic algorithm, is used. That is, a maintenance operation simulation is repeated with randomly set "visit interval" and "replacement interval", thus calculating the cost. Of these, the "visit interval" and the "replacement interval" that minimize the cost are employed.

The cost in this case refers to the sum of the labor costs required for repair by the serviceman, the material costs of replaced consumable parts, and the loss caused by the unavailability of the machine to the user due to unexpected machine failure, that is, downtime loss. It is desired that a sufficiently longer period than the average failure time of the machine is set as a preset value of the simulation period. However, as the simulation time is longer, the calculation time is longer accordingly.

An example of conducting a maintenance operation simulation using the Monte Carlo method will be described.

FIG. 11 shows samples used for a simulation. These samples are maintenance scheduling strategy samples for a machine having "machine.ID" of "100213". A maintenance scheduling strategy sample is a sample specified by combining the "visit interval" and "replacement interval" with each consumable part. Here, two thousand patterns of maintenance scheduling strategy samples are randomly created. Basically, the samples are randomly generated. However, in order to prevent creation of unwanted samples, it is desired that samples are generated closely to visit intervals and replacement intervals that are expected from experience based on the failure probability distribution or the like of each consumable part. The maintenance operation simulation is conducted with each of these 2000 patterns of maintenance scheduling strategies, and the sample that minimizes the cost is found.

Figure 12:
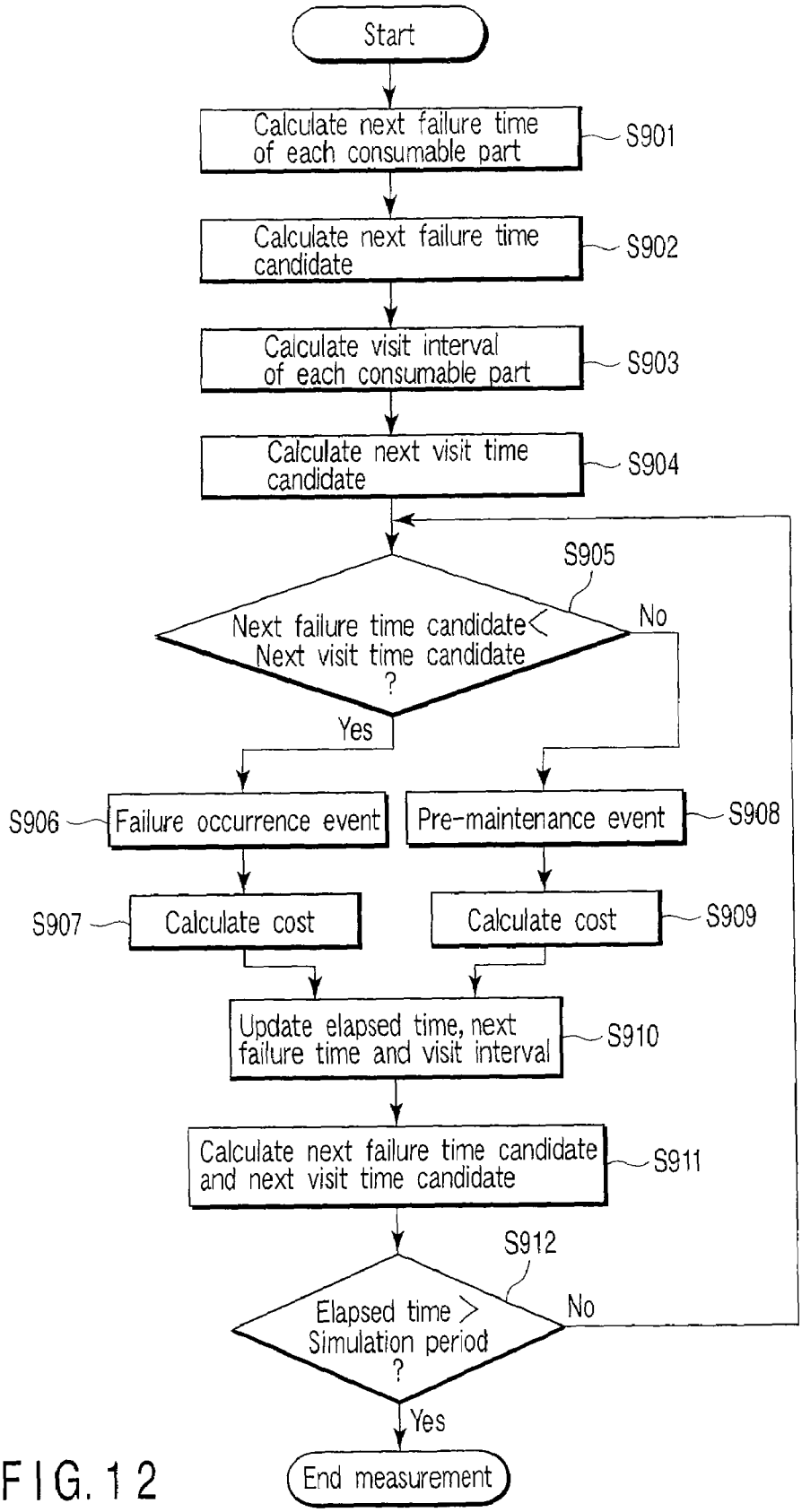
FIG. 12 is a flowchart showing schematic procedures of a maintenance operation simulation.

Next, the maintenance operation simulation using the maintenance scheduling strategy samples shown in FIG. 11 will be described. FIG. 12 is a flowchart showing schematic procedures of the maintenance operation simulation.

The maintenance scheduling unit 206 searches for the "machine" table 304 having "machine.ID" of "100213" and extracts "machine type.name" in the "machine" table 304. Then, it extracts all the "consumable part" tables 305 having the extracted "machine type.name".

In step S901, the maintenance scheduling unit 206 generates random numbers based on the failure probability represented by "failure distribution classification", "failure distribution parameter 1" and "failure distribution parameter 2" in the "consumable part" table 305, and calculates the next failure time of each consumable part. In step S902, the shortest one of the calculated next failure times is set as a next failure occurrence time candidate.

Meanwhile, the maintenance scheduling unit 206 collates "ID" in the "machine" table 304 with "machine.ID" in the "consumable part status" table 308. All the "consumable part status" tables 308 having the matching "machine.ID" are extracted, and the next visit schedule of the serviceman is calculated.

That is, in step S903, the "visit interval" set in the "consumable part status" table 308 is referred to with respect to each extracted consumable part status. In step S904, the shortest time is set as a next visit time candidate.

In step S905, the next failure occurrence time candidate calculated on the basis of the failure probability is compared with the next visit time candidate acquired from the "consumable part status" stable 308, and an event is decided.

If it is Yes in step S905, that is, if the next failure time candidate is shorter than the next visit time candidate, failure occurs before the visit. Therefore, in step S906, the next failure time candidate is adopted as an elapsed time for a failure occurrence event. In step S907, the consumable part to be replaced is decided and the required cost is calculated.

The cost is calculated in the following manner. With respect to all the consumable parts except for the consumable part in which failure has occurred, the "replacement interval" in the "consumable part status" table 308 is referred to. Then, the consumable part having a "replacement interval" shorter than the next failure replacement time candidate is decided as the consumable part to be replaced. The cost in this case is expressed by the following equation (2).

$$\text{Cost}=\text{labor costs}+\text{material costs}+\text{downtime loss} \quad (2)$$

where labor costs=("user.traveling time"+Σ "consumable part.replacement time" of consumable part to be replaced)×serviceman unit price, material costs=Σ "consumable part.unit price" of consumable part to be replaced, and downtime loss="user.traveling time"×"machine.downtime loss unit price"

"User.traveling time" represents the traveling time from the support center 203 to the user's location.

If it is No in step S905, that is, if the next failure time candidate is equal to or longer than the next visit time candidate, failure does not occur before the visit and therefore the next visit time candidate is adopted as an elapsed time for a pre-maintenance event in step S908. In step S909, the consumable part to be replaced is decided and the required cost is calculated.

The cost is calculated in the following manner. With respect to all the consumable parts except for the consumable part for which pre-maintenance is to be performed because the visit interval is reached, the "replacement interval" in the "consumable part status" table 308 is referred to. Then, the consumable part having a "replacement interval" shorter than the next visit time candidate is decided as the consumable part to be replaced. The cost is this case is expressed by the following equation (3).

$$\text{Cost}=\text{labor costs}+\text{material costs}+\text{downtime loss} \quad (3)$$

where labor costs=("user.traveling time"+Σ "consumable part.replacement time" of consumable part to be replaced)×serviceman unit price material costs=Σ "consumable part.unit price" of consumable part to be replaced downtime loss=0

Here, the downtime is considered to be the time from when unexpected failure occurs until the serviceman comes. The operation time in which the serviceman 202 restores the machine from failure is not included in the downtime. This is because the serviceman 202 is considered to be carrying out the failure recovery operation when the user is not using the machine, by agreement with the user.

In step S910, a next failure time is newly calculated for the replaced consumable part, and for the consumable part that has not been replaced, values obtained by subtracting the elapsed time from each of the calculated next failure time and the visit interval are used for updating the next failure time and the visit interval. In step S911, a next failure time candidate and a next visit time candidate are similarly decided. If it is No in step S912, that is, if the elapsed time has not reached the simulation period, the decision of an event, the decision of a consumable part to be replaced, and the calculation of the cost are repeated. If it is Yes in step S912, that is, if the elapsed time has reached the simulation period, the maintenance operation simulation ends.

The above simulation is assumed to be one set, and the simulation is conducted with respect to all the maintenance scheduling strategy samples shown in FIG. 11. FIG. 13 is a view showing the result of simulation for each sample. The maintenance scheduling strategy sample that minimizes the calculated cost is employed as the optimum strategy. In this example, the $112^{th}$ sample has the minimum cost per count and is employed as the optimum strategy. The "visit interval" and "replacement interval." of the optimum strategy are set into "visit interval" and "replacement interval" in the "consumable part status" table 308 for each consumable part.

The MFP 201 downloads the "visit interval" and "replacement interval" in the "consumable part status" table 308 as additional information at the time of regular communication, and sets them into its own memory. Therefore, the MFP 201 can properly present the "visit interval" and "replacement interval." of the optimum strategy on its own display panel to the user. FIG. 14 is a view showing an example of information held in the memory of the MFP 201.

Next, the "visit date presentation mode" will be described. In the "visit date presentation mode", a case where the serviceman 202 constantly confirms the next visit date, that is, the visit timing for the apparatus, is considered.

A desired "visit interval" and "replacement interval" are set in advance by the above-described "strategy planning mode". The serviceman 202 inputs "machine.ID" of the machine which the serviceman takes charge of, by the operation input unit, not shown, at the service center 203, thereby confirming the next visit date.

Figure 15:
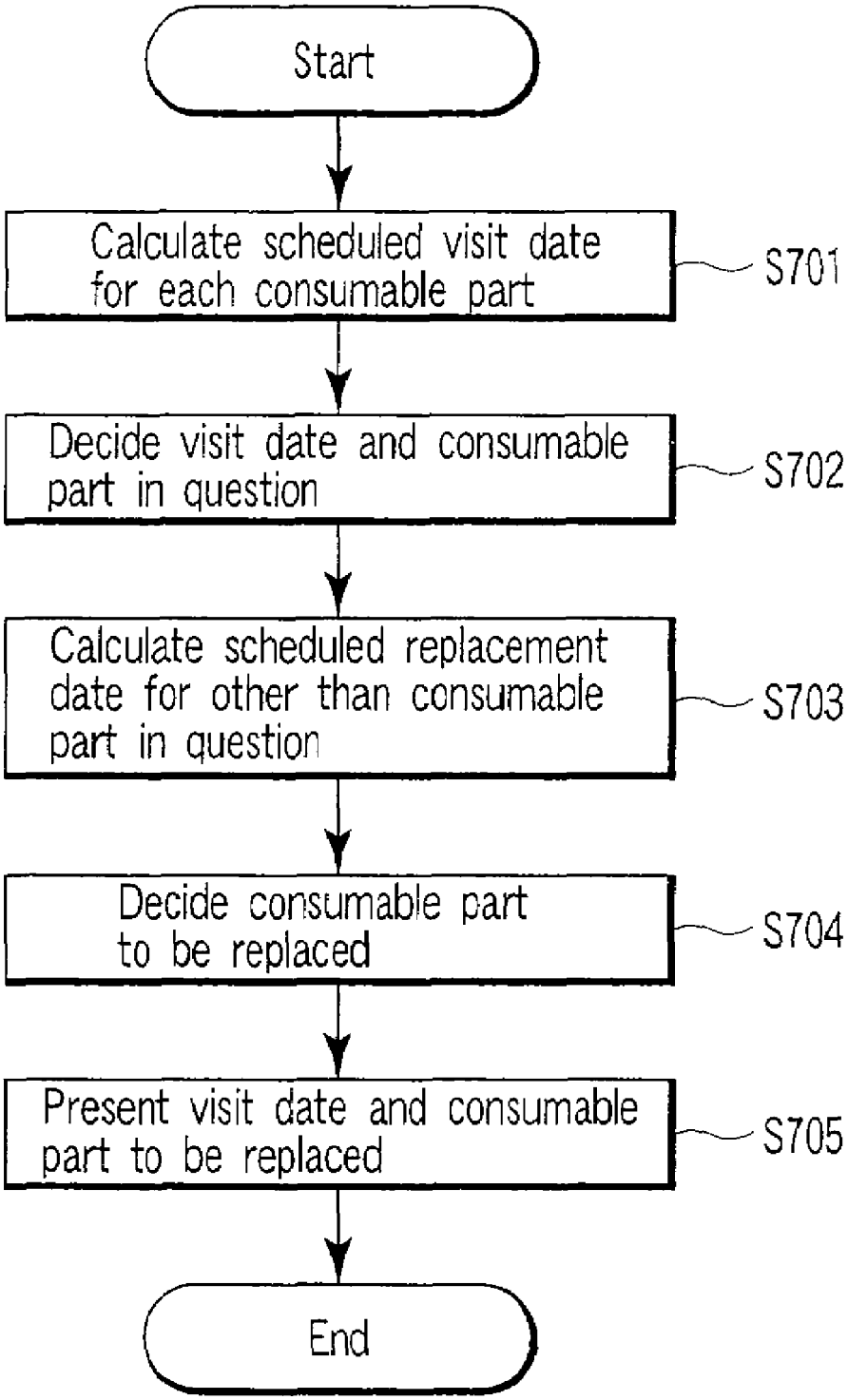
FIG. 15 is a flowchart showing schematic processing procedures in a "visit date presentation mode".

FIG. 15 is a flowchart showing schematic processing procedures in the visit date presentation mode.

The maintenance scheduling unit 206 collates "ID" in the "machine" table 304 with "machine.ID" in the "consumable part status" table 308. It extracts all the matching "consumable part status" tables 308 and refers to "counter acquisition date", "counter", "visit interval" and "replacement interval". Also, it refers to "counter proceeding average" from the "machine" table 304.

In step S701, the maintenance scheduling unit 206 calculates the next scheduled visit date for each consumable part. The next scheduled visit date is expressed by the following equation (4).

$$\text{Scheduled visit date}=\text{counter acquisition date}+(\text{visit interval}-\text{counter})/\text{counter processing average} \quad (4)$$

In step S702, of the scheduled visit dates for the respective consumable parts, the nearest one is decided as the visit date. In step S703, with respect to the consumable parts having the other schedule visit dates than the nearest one, the scheduled replacement date is calculated. The scheduled replacement date is expressed by the following equation (5).

$$\text{Scheduled replacement date}=\text{counter acquisition date}+(\text{replacement interval}-\text{counter})/\text{counter proceeding average} \quad (5)$$

In step S704, the consumable part having a scheduled replacement date that is nearer than the visit date is decided as the consumable part to be replaced. In step S705, the consumable part to be replaced is presented together with the visit date by the output device 25. FIG. 16 shows exemplary output results in the visit date presentation mode.

Other than the above-described processing, it is possible to express "counter proceeding average" in equations (4) and (5) as a section and to estimate the visit date as a period, utilizing "counter proceeding distribution" in the "machine" table 304.

Second Embodiment

Next, a second embodiment of this invention will be described.

This embodiment is a modification of the above-described first embodiment and the basic system configuration is the same. Hereinafter, the same parts as those described already in the first embodiment are denoted by the same numerals and will not be described further in detail.

In this embodiment, the MFP 201 as an apparatus that is a maintenance target has a cartridge in which a photoconductive unit 102, a charger 103, a cleaner 108, a developing unit 105 and the like are integrally formed as a unit. The cartridge is attachable to and removable from the main body.

In such a cartridge with various components integrated therein, replacement is necessary if one of the components constituting the cartridge is broken.

Therefore, in the "strategy planning mode", the "visit interval" and "replacement interval" set in the "consumable part status" table 308 are set to the same value with respect to all the components constituting the cartridge, and then set to minimize the calculated cost.

Since the cartridge can be easily attached and removed, even the user can replace it. In view of the cost and efficiency of the maintenance services, it is preferable that the replacement of such easily replaceable consumable parts is carried out on the user side as long as possible.

Figure 17:
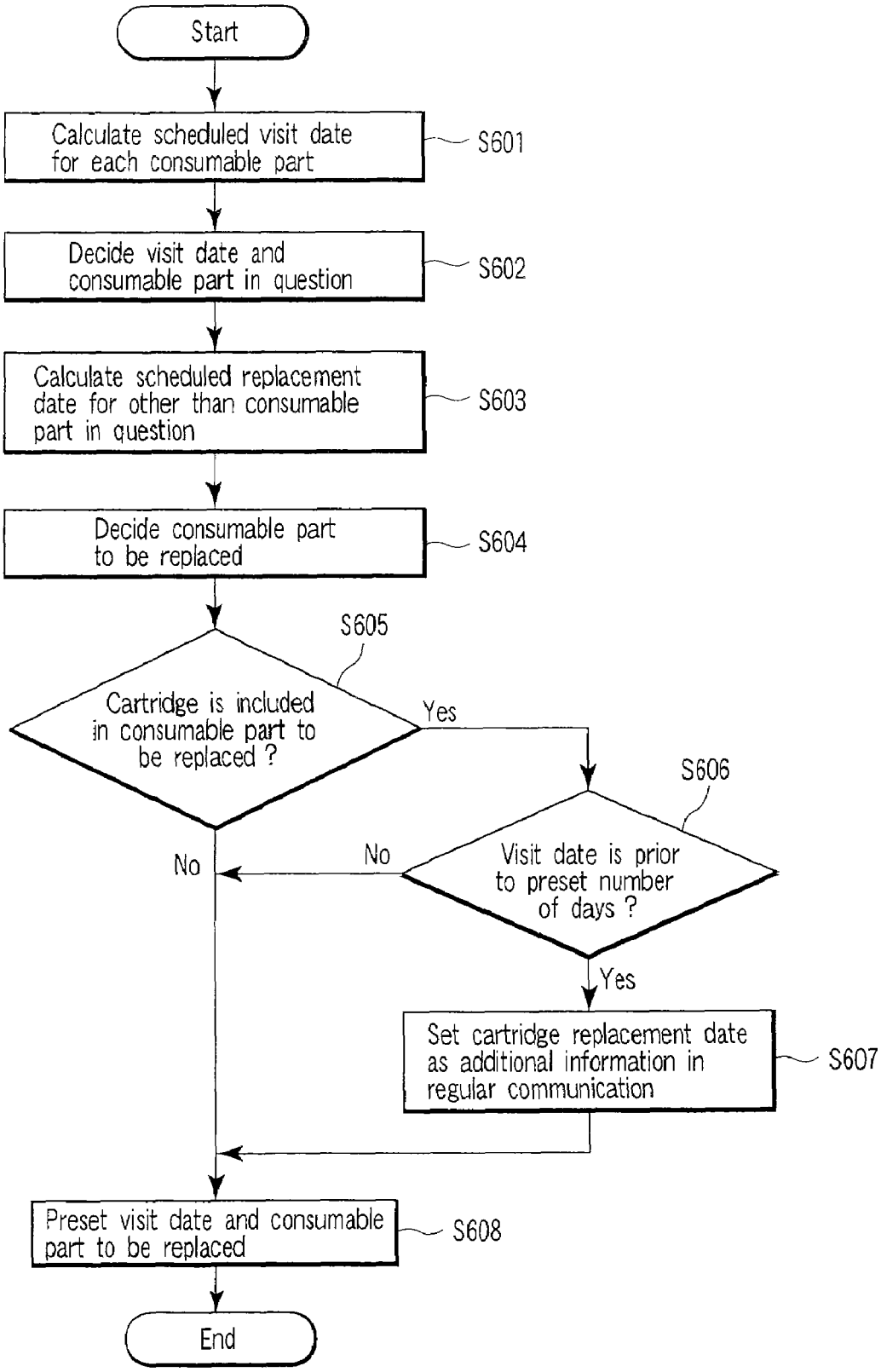
FIG. 17 is a flowchart showing schematic processing procedures in a "visit date presentation mode".

FIG. 17 is a flowchart showing schematic processing procedures in the "visit date presentation mode" in this embodiment. The processing of steps S601 to S604 in the flowchart shown in FIG. 17 is similar to the processing of steps S701 to S704 shown in FIG. 15 in the first embodiment. Therefore, the processing of S605 and the subsequent steps will be described.

As the consumable part to be replaced on the visit date for the apparatus that is the maintenance target is decided by the maintenance scheduling unit 206 in step S604, it is determined in step S605 whether or not a component of the cartridge is included in the list of consumable parts to be replaced.

If it is No in step S605, that is, if a component of the cartridge is not included in the list of consumable parts to be replaced on the visit date, the decided visit date and the list of consumable parts to be replaced on the visit date are outputted to the output device 25 in step S608.

If it is Yes in step S605, that is, if a component of the cartridge is included in the list of consumable parts to be replaced on the visit date, it is checked in step S606 whether the decided visit date is prior to a preset number of days.

If it is Yes in step S606, that is, if the decided visit date is prior to the preset number of days, the visit date is registered as a "cartridge replacement date" to the storage unit 205 in step S607.

The MFP 201 downloads the information of the "cartridge replacement date" stored in the storage unit 205 as additional information in regular communication, and displays a message of cartridge replacement on a control panel, not shown, provided in the MFP 201.

Thus, for consumable parts that can be replaced on the user side, the replacement operation is carried out on the user side without having the serviceman 202 visit there, and for consumable parts that are difficult to replace on the user side, the user can have the serviceman 202 visit. Thus, improvement in the operation efficiency in the maintenance operation can be realized.

In this embodiment, the case where the function to carry out the invention has been recorded in advance within the apparatus is described. However, other than this, the similar function may be downloaded to the apparatus from a network, or the similar function stored in a recording medium may be installed into the apparatus. As a recording medium, any form of recording medium that can store a program and that is readable by the apparatus, such as a CD-ROM, may be used. Also, the function acquired in advance by installing or downloading may be realized in cooperation with the OS (operating system) or the like in the apparatus.

As described above, according to this embodiment, by setting the two criteria for determination of "visit interval" and "replacement interval" for individual consumable parts, the serviceman can grasp "when to visit" and "which consumable parts should be replaced". Also, since a desired visit interval and replacement interval (strategy) is calculated in advance by using the "strategy planning mode" and the next visit date is usually calculated on the basis of the decided strategy by using the "visit date presentation mode", the cost required for the calculation can be reduced. Moreover, since the status of use of the apparatus that is a maintenance target can be gathered in real time by using the communication unit, the certainty of prediction of a visit date for the apparatus is significantly improved. Also, since it can be recorded whether the replacement of a consumable part is due to the end of its life or not, the failure probability distribution can be accurately estimated.

This invention has been described in detail by using the specific embodiments. However, it is obvious to those skilled in the art that various changes and modifications can be made without departing from the spirit and scope of the invention. According to this invention, as described above in detail, a technique can be provided that enables reduction in the cost related to the maintenance services and that also enables reduction in the downtime of the product.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A maintenance scheduling system for creating a maintenance schedule for an image forming apparatus that forms an image and sends and receives information to and from an external device, the system comprising:

an actual use information acquiring unit configured to acquire actual use information of the image forming apparatus and actual use information of a consumable part;

a failure probability distribution estimating unit configured to estimate failure probability distribution of the consumable part on the basis of history of actual use information of the consumable part;

a counter proceeding degree acquiring unit configured to acquire a counter proceeding degree, which is a counter value per day, on the basis of history of actual use information of the image forming apparatus; and a maintenance scheduling unit configured to present next replacement timing and a consumable part to be replaced, on the basis of the failure probability distribution of each of the consumable parts and the counter proceeding degree.

2. The maintenance scheduling system according to claim 1, wherein the consumable part includes a cartridge in which plural consumable parts having different functions from each other are integrated as a unit.

3. The maintenance scheduling system according to claim 1, wherein:

the actual use information of the image processing apparatus includes a counter value corresponding to the number of times an image is formed and the date and time when the counter value is acquired; and the actual use information of a consumable part includes the counter value at the time of replacing the consumable part and life information indicating whether the reason for replacement of the consumable part is the end of its life or not.

4. The maintenance scheduling system according to claim 1, further comprising:

an interval information acquiring unit configured to acquire interval information formed by a combination of a visit interval representing a time interval at which a visit should be made for a maintenance operation of each consumable part and a replacement interval representing a time interval at which replacement of each consumable part should be carried out;

a failure occurrence timing calculating unit configured to find next failure occurrence timing for each consumable part on the basis of the failure probability distribution of each of the consumable parts and the counter proceeding degree;

a cost calculating unit configured to calculate a cost required with respect to the image forming apparatus on the basis of the next failure occurrence timing of each consumable part and the interval information;

a selecting unit configured to select, as optimum interval information, a combination of the visit interval and the replacement interval that realizes a minimum cost of the calculated costs; and a presenting unit configured to present next replacement timing and a consumable part to be replaced, on the basis of the selected interval information.

5. The maintenance scheduling system according to claim 4, wherein the failure occurrence timing calculating unit calculates a next failure time of each consumable part based on the failure probability of each of the consumable parts, and finds next failure occurrence timing based on the shortest time of the calculated next failure times and the counter proceeding degree.

6. The maintenance scheduling system according to claim 4, wherein the cost is the sum of labor costs required for a maintenance operation by a serviceman, material costs of consumable pans, and a loss caused by unavailability of the image forming apparatus to a user.

7. The maintenance scheduling system according to claim 4, wherein the cost calculating unit carries out search processing using a Monte Carlo method or genetic algorithm based on the visit interval and the replacement interval, thereby finding a combination of the visit interval and the replacement interval that minimizes the cost.

8. The maintenance scheduling system according to claim 4, wherein the visit interval for each consumable part is set to be longer than the replacement interval.

9. The maintenance scheduling system according to claim 4, wherein the visit interval and the replacement interval have a value close to an interval with which it is predicted that the failure probability is equal to or higher than a predetermined probability, on the basis of the failure probability distribution of each consumable part.

10. A maintenance scheduling method for creating a maintenance schedule for an image forming apparatus that forms an image and sends and receives information to and from an external device, the method comprising:

acquiring actual use information of the image forming apparatus and actual use information of a consumable part;

estimating failure probability distribution of the consumable part on the basis of history of actual use information of the consumable part;

acquiring a counter proceeding degree, which is a counter value per day, on the basis of history of actual use information of the image forming apparatus; and presenting next replacement timing and a consumable part to be replaced, on the basis of the failure probability distribution of each of the consumable parts and the counter proceeding degree.

11. The maintenance scheduling method according to claim 10, wherein the consumable part includes a cartridge in which plural consumable parts having different functions from each other are integrated as a unit.

12. The maintenance scheduling method according to claim 10, wherein:

the actual use information of the image processing apparatus includes a counter value corresponding to the number of times an image is fromed and the date and time when the counter value is acquired; and the actual use information of a consumable part includes the counter value at the time of replacing the consumable part and life information indicating whether the reason for replacement of the consumable part is the end of its life or not.

13. The maintenance scheduling method according to claim 10, further comprising:

acquiring interval information formed by a combination of a visit interval representing a time interval at which a visit should be made for a maintenance operation of each consumable part and a replacement interval representing a time interval at which replacement of each consumable part should be carried out;

finding next failure occurrence timing for each consumable part on the basis of the failure probability distribution of each of the consumable parts and the counter proceeding degree;

calculating a cost required with respect to the image forming apparatus on the basis of the next failure occurrence timing of each consumable part and the interval information;

selecting, as optimum interval information, a combination of the visit interval and the replacement interval that realizes a minimum cost of the calculated costs; and presenting next replacement timing and a consumable part to be replaced, on the basis of the selected interval information.

14. The maintenance scheduling method according to claim 13, wherein the finding next failure occurrence timing includes calculating a next failure time of each consumable part based on the failure probability of each of the consumable parts, and finding next failure occurrence timing based on the shortest time of the calculated next failure times and the counter proceeding degree.

15. The maintenance scheduling method according to claim 11, wherein the cost is the sum of labor costs required for a maintenance operation by a serviceman, material costs of consumable pans, and a loss caused by unavailability of the image forming apparatus to a user.

16. The maintenance scheduling method according to claim 13, wherein the calculating a cost required with respect to the image forming apparatus includes carrying out search processing using a Monte Carlo method or genetic algorithm based on the visit interval and the replacement interval, thereby finding a combination of the visit interval and the replacement interval that minimizes the cost.

17. The maintenance scheduling method according to claim 13, wherein the visit interval for each consumable part is set to be longer than the replacement interval.

18. The maintenance scheduling method according to claim 13, wherein the visit interval and the replacement interval have a value close to an interval with which it is predicted that the failure probability is equal to or higher than a predetermined probability, on the basis of the failure probability distribution of each consumable part.

19. An image forming apparatus that forms an image and sends and receives information to and from an external device, the apparatus comprising:

a storage unit configured to store actual use information of the image forming apparatus and actual use information of a consumable part; and an information transmitting unit to transmit the actual use information of the image forming apparatus and the actual use information of the consumable part to a maintenance scheduling system for creating a maintenance schedule for the image forming apparatus, the maintenance scheduling system comprising:

an actual use information acquiring unit configured to acquire actual use information of the image forming apparatus and actual use information of a consumable part;

a failure probability distribution estimating unit configured to estimate failure probability distribution of the consumable part on the basis of history of actual use information of the consumable part;

a counter proceeding degree acquiring unit configured to acquire a counter proceeding degree, which is a counter value per day, on the basis of history of actual use information of the image forming apparatus; and a maintenance scheduling unit configured to present next replacement timing and a consumable part to be replaced, on the basis of the failure probability distribution of each of the consumable parts and the counter proceeding degree.

20. The image forming apparatus according to claim 19, wherein:

the actual use information of the image processing apparatus includes a counter value corresponding to the number of times an image is formed and the date and time when the counter value is acquired; and the actual use information of a consumable part includes the counter value at the time of replacing the consumable part and life information indicating whether the reason for replacement of the consumable part is the end of its life or not.

21. The image forming apparatus according to claim 19, further comprising:

an index storage unit configured to store two indexes indicating a visit interval representing a time interval at which a visit should be made for a maintenance operation of each consumable part and a replacement interval representing a time interval at which replacement of each consumable part should be carried out; and an information receiving unit configured to receive the two indexes indicating the visit interval and the replacement interval from the maintenance scheduling system.

22. The image forming apparatus according to claim 21, wherein the consumable part includes a cartridge in which plural consumable parts are integrated as a unit, the information receiving unit further receives information related to a scheduled replacement date of the cartridge from the maintenance scheduling system, and the apparatus further includes a display unit configured to preset the scheduled replacement date of the cartridge from the received information.

* * * * *

UNITED STATES PATENT AND TRADEMARK OFFICE

CERTIFICATE OF CORRECTION

PATENT NO. : 7,467,841 B2
APPLICATION NO. : 11/470963
DATED : December 23, 2008
INVENTOR(S) : Kamisuwa et al.

It is certified that error appears in the above-identified patent and that said Letters Patent is hereby corrected as shown below:

Column 15, line 43: replace “pans” with --parts--.

Column 16, line 19: replace “fromed” with --formed--.

Column 16, line 58: replace “pans” with --parts--.

Signed and Sealed this

Tenth Day of March, 2009

JOHN DOLL
*Acting Director of the United States Patent and Trademark Office*